US010849363B2

(12) United States Patent
Wang et al.

(10) Patent No.: US 10,849,363 B2
(45) Date of Patent: Dec. 1, 2020

(54) ATOMIZER AND E-CIGARETTE

(71) Applicant: O-NET AUTOMATION TECHNOLOGY (SHENZHEN) LIMITED, Guangdong (CN)

(72) Inventors: Cheng Wang, Guangdong (CN); Mingjing Hu, Guangdong (CN); Zhidong Zeng, Guangdong (CN); Yongquan Zhou, Guangdong (CN); Huihua Huang, Guangdong (CN); Bo Zhou, Guangdong (CN); Fei Shen, Guangdong (CN)

(73) Assignee: O-NET AUTOMATION TECHNOLOGY (SHENZHEN) LIMITED, Shenzhen (CN)

( * ) Notice: Subject to any disclaimer, the term of this patent is extended or adjusted under 35 U.S.C. 154(b) by 343 days.

(21) Appl. No.: 15/956,784

(22) Filed: Apr. 19, 2018

(65) Prior Publication Data

US 2018/0235281 A1 Aug. 23, 2018

Related U.S. Application Data

(63) Continuation of application No. PCT/CN2015/099083, filed on Dec. 27, 2015.

(30) Foreign Application Priority Data

Oct. 20, 2015 (CN) ..... 2015 2 0817462 U

(51) Int. Cl.
*A24F 13/00* (2006.01)
*A24F 17/00* (2006.01)
(Continued)

(52) U.S. Cl.
CPC ..... *A24F 47/008* (2013.01); *A24F 47/00* (2013.01)

(58) Field of Classification Search
CPC ..... A24F 47/008; A24F 40/90
(Continued)

(56) References Cited

U.S. PATENT DOCUMENTS 10,750,789 B2 * 8/2020 Memari ..... B65D 25/005
2014/0041655 A1 * 2/2014 Barron ..... A61M 15/06 128/202.21
(Continued)

FOREIGN PATENT DOCUMENTS

CN 104336778 * 2/2011 ..... A24F 47/008
CN 104305526 A 1/2015
(Continued)

OTHER PUBLICATIONS

International Search Report of PCT Patent Application No. PCT/CN2015/099083 dated Jul. 21, 2016.

*Primary Examiner* — Abdullah A Riyami
*Assistant Examiner* — Thang H Nguyen

(57) ABSTRACT

The present invention relates to the technical field of e-cigarettes, and provides an atomizer and an e-cigarette that is obtained by connecting the atomizer to an electronic battery rod. The atomizer includes an electrode component and a heating component. An air passage for discharging an aerosol and a holding base for holding the heating component are disposed inside the liquid storage apparatus. An accommodating part is disposed in the holding base, and the heating component is fixedly accommodated inside the accommodating part. According to the present invention, the accommodating part is disposed in the holding base, and the heating component is disposed inside the accommodating part, so that the heating component does not fall off or leak e-liquid due to vibration, high temperature, and inclination.

9 Claims, 11 Drawing Sheets

(51) Int. Cl.
*A24F 25/00* (2006.01)
*A24F 47/00* (2020.01)

(58) Field of Classification Search
USPC ..... 131/329, 328
See application file for complete search history.

(56) References Cited

U.S. PATENT DOCUMENTS

| | | | | |
|---|---|---|---|---|
| 2015/0201674 | A1* | 7/2015 | Dooly | A24F 47/008 53/432 |
| 2015/0223522 | A1* | 8/2015 | Ampolini | A61M 15/06 131/328 |
| 2015/0245654 | A1* | 9/2015 | Memari | G01F 23/00 141/2 |
| 2015/0335071 | A1* | 11/2015 | Brinkley | H05B 1/0297 131/328 |
| 2016/0066621 | A1* | 3/2016 | DePiano | A24F 47/008 131/328 |
| 2016/0073692 | A1* | 3/2016 | Alarcon | A24F 47/008 131/329 |
| 2016/0331030 | A1* | 11/2016 | Ampolini | A24F 47/008 |
| 2017/0222468 | A1* | 8/2017 | Schennum | H02J 7/027 |
| 2017/0258138 | A1* | 9/2017 | Rostami | A61M 11/042 |
| 2017/0295846 | A1* | 10/2017 | Liu | A24F 47/00 |
| 2018/0027873 | A1* | 2/2018 | Nakano | A24F 40/70 |

FOREIGN PATENT DOCUMENTS

| | | | |
|---|---|---|---|
| CN | 104336778 | A | 2/2015 |
| CN | 104720114 | A | 6/2015 |
| KR | 20120098343 | A | 9/2012 |

* cited by examiner

ATOMIZER AND E-CIGARETTE

CROSS-REFERENCE TO RELATED APPLICATIONS

The present application is a Continuation Application of PCT application No. PCT/CN2015/099083 filed on Dec. 27, 2015, which claims the benefit of Chinese Utility Model Application No. 201520817462.2 filed on Oct. 20, 2015. The contents of all of the above are hereby incorporated by reference.

TECHNICAL FIELD

The present invention relates to the technical field of e-cigarettes, in particular to an atomizer and an e-cigarette.

BACKGROUND

At present, an e-cigarette on the market includes two parts: an atomizer and a battery rod. In the atomizer, there are many parts, among which a heating component includes a glass fiber wick for conveying e-liquid. A heating filament winds around the glass fiber wick. The glass fiber wick is prone to generate glass fiber crumbs when being heated. When an aerosol produced after e-liquid atomization is inhaled into lungs by a user, the glass fiber crumbs entering the lungs of the human body are difficult to discharge, and the glass fiber crumbs easily pierce through mucous membranes like glass. This imposes an adverse effect on human health. In addition, when the glass fiber wick is soaked with e-liquid, the user can easily inhale the e-liquid when making a puff strongly. When not in use, the e-liquid flows into the battery rod along the air passage and damages the battery. Moreover, during manufacturing of e-cigarettes, the glass fiber wick is relatively soft and easily causes the heating filament winding around the glass fiber wick to touch and short-circuit, or decreases a resistance value of the heating filament. As a result, the aerosol has a poor taste and a service life of the heating filament is affected. Due to a complex structure with excessive components, the atomizer is difficult to implement automatic production, resulting in a low production efficiency, a high defect rate, and poor user experience. Therefore, it is necessary to develop a brand-new atomizer structure.

SUMMARY

In view of the foregoing defects in the prior art, the technical issue to be resolved by the present invention is to provide an atomizer having high stability and a simple structure and convenient for automatic production.

Another technical issue to be resolved by the present invention is to provide an e-cigarette, where the e-cigarette has such advantages as a simple structure, low costs, better leakage-proof effects, excellent electrical contact, and convenient automatic production.

The technical solution used by the present invention to resolve the technical issue thereof is to provide an e-cigarette atomizer, configured to combine with a battery rod to form an e-cigarette, where the atomizer includes an electrode component and a heating component, a liquid storage apparatus for storing liquid is disposed at one end of the electrode component and a battery of the battery rod is electrically connected to the other end of the electrode component, an air passage for discharging aerosol and a holding base for holding the heating component are disposed inside the liquid storage apparatus, an accommodating part is disposed in the holding base, and the heating component is fixedly accommodated inside the accommodating part.

According to a further solution of the present invention, the accommodating part is a through-hole penetrating the holding base.

According to a further solution of the present invention, the holding base is further provided with a first ventilation groove or hole and a second ventilation groove or hole, the first ventilation groove or hole and the second ventilation groove or hole communicate with each other, and a step for stopping e-liquid droplets of the aerosol is disposed at a joint between the first ventilation groove or hole and the second ventilation groove or hole.

According to a further solution of the present invention, an e-liquid stopping ring closely fitting the liquid storage apparatus and a liquid conveying groove for conveying the e-liquid are disposed in the holding base, and the liquid conveying groove communicates with the through-hole.

According to a further solution of the present invention, the holding base is further provided with a conductor electrically connected to the heating component, and the conductor is inserted into the holding base or is integrally molded with the holding base.

According to a further solution of the present invention, the conductor includes a first conductor and a second conductor, the electrode component includes a connector, an inner electrode, and an insulating ring mounted between the connector and the inner electrode, the first conductor is electrically connected to the connector and the second conductor is electrically connected to the inner electrode, or the first conductor is electrically connected to the inner electrode and the second conductor is electrically connected to the connector.

According to a further solution of the present invention, there are one or more heating components.

According to a further solution of the present invention, the holding base is integrally molded with the connector, the holding base is provided with any one or a combination of a magnet, a clasp, or a thread, and the atomizer is connected to the battery rod by using the magnet, the clasp, or the thread.

The present invention further provides an e-cigarette including a battery rod, where the battery rod is integrally molded with or detachably connected to the atomizer.

The beneficial effect of the present invention lies in that, compared with the prior art, the present invention provides the accommodating part in the holding base, and the heating component is disposed inside the accommodating part, so that the heating component does not fall off or leak e-liquid due to vibration, high temperature, and inclination. This also avoids adverse effects that a glass fiber wick brings to human health. In addition, the holding base is provided with a conductor, and the heating component disposed in the accommodating part may come in contact with the conductor, so that assembly thereof is simple and facilitates automatic production. The atomizer and the e-cigarette provided by the present invention have such advantages as a simple structure, low costs, better leakage-proof effects, excellent electrical contact, and convenient automatic production.

BRIEF DESCRIPTION OF DRAWINGS

The present invention is further described with reference to the embodiments and the accompany drawings in which.

DESCRIPTION OF EMBODIMENTS

Herein, examples of the embodiments of the present invention are described in detail with reference to the accompanying drawings.

Figure 1:
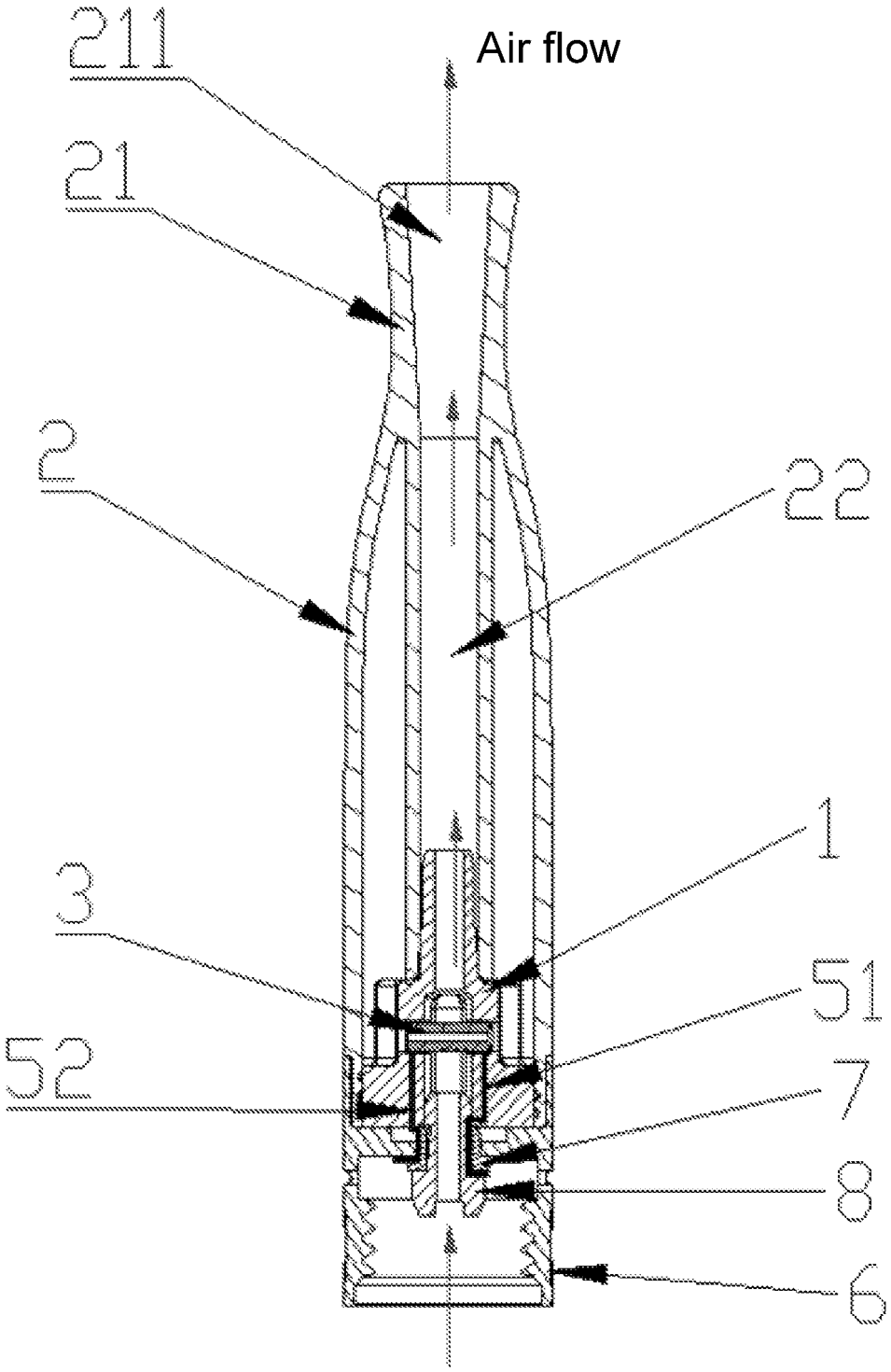
FIG. 1 is a schematic structural diagram of an atomizer according to the present invention.
Figure 2:
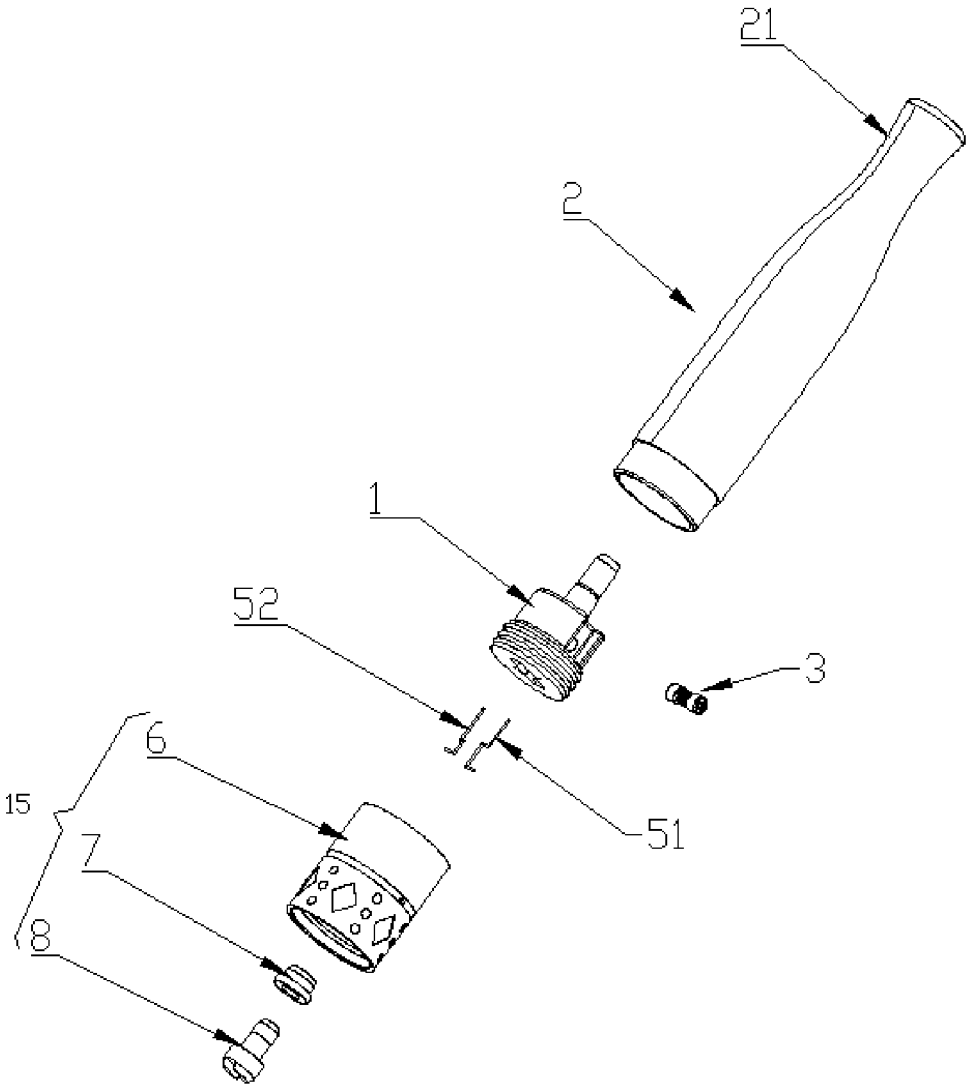
FIG. 2 is a schematic exploded diagram of an atomizer according to the present invention.

As shown in FIG. 1 and FIG. 2, an embodiment of the present invention provides an atomizer including a holding base 1, a liquid storage apparatus 2, a heating component 3, and an electrode component 15. The electrode component 15 includes a connector 6, an internal electrode 8, and an insulating ring 7 mounted between the connector 6 and the inner electrode 8. The liquid storage apparatus 2 includes a mouthpiece 21 and an air passage 22, and the mouthpiece 21 is provided with an air outlet hole 211. The air outlet hole 211 communicates with the air passage 22 to transfer atomized aerosol to a mouth of a user. The mouthpiece 21 is integrally molded with or detachably connected to the liquid storage apparatus 2, so as to facilitate the user's cleaning or replacing of the mouthpiece 21 and keep the mouthpiece clean and sanitary.

As shown in FIG. 1, the holding base 1 is provided with a conductor 5. The conductor includes a first conductor 51 and a second conductor 52, so that the first conductor 51 is abutted or clamped or welded to the connector 6 to form electrical connection, and the second conductor 52 is abutted or clamped or welded to the inner electrode 8 to form electrical connection, or so that the first conductor 51 is abutted or clamped or welded to the inner electrode 8 to form electrical connection, and the second conductor 52 is abutted or clamped or welded to the connector 6 to form electrical connection. Preferably, the holding base 1 and the conductor 5 are integrally molded, to prevent e-liquid from seeping out from a gap of the conductor.

Figure 13:
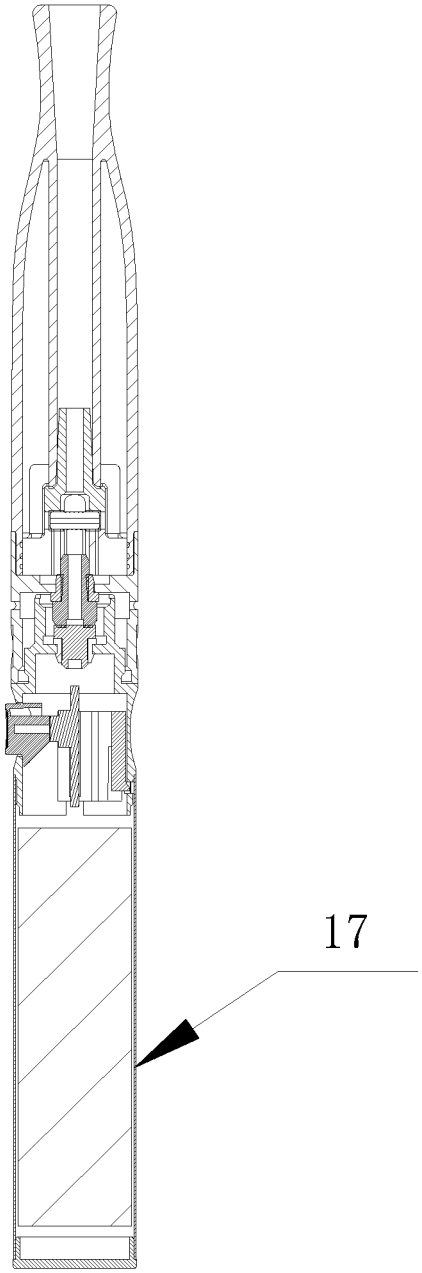
FIG. 13 is a cross-sectional view of an e-cigarette according to the present invention.

As shown in FIG. 1 and FIG. 13, the electrode component 15 is disposed at one end of the liquid storage apparatus 2 away from the mouthpiece 21 and is configured to electrically connect to a battery rod 17 stably. The heating component 3 comes in contact with the conductor 5 to form a connected circuit. After the user connects the atomizer to the corresponding battery rod 17 and the circuit is connected, the atomizer instantly operates or enters an operating state.

As shown in FIG. 1 and FIG. 2, the conductor 5 is a conductor with conductivity performance, for example an electrical wire, a nickel wire, a copper wire, or an iron wire.

Figure 3:
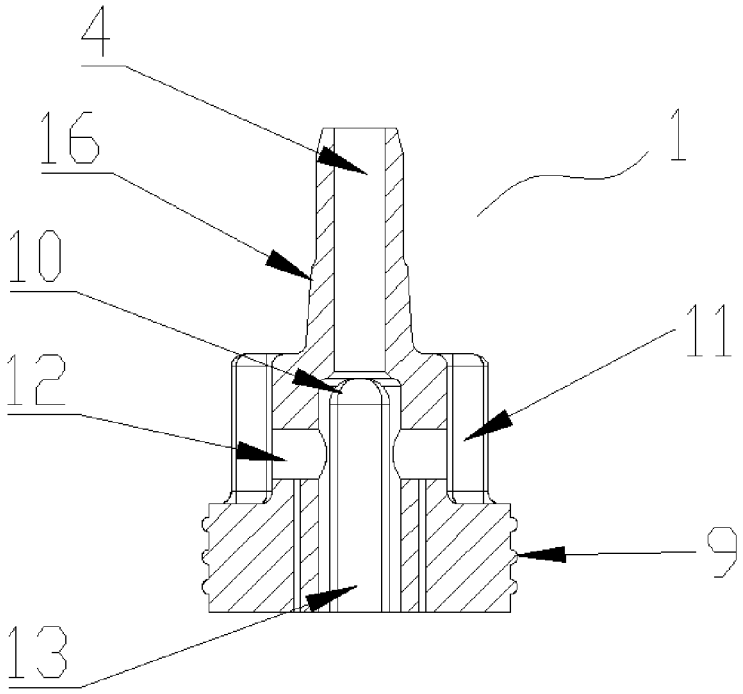
FIG. 3 is a schematic sectional diagram of a holding base according to the present invention.
Figure 4:
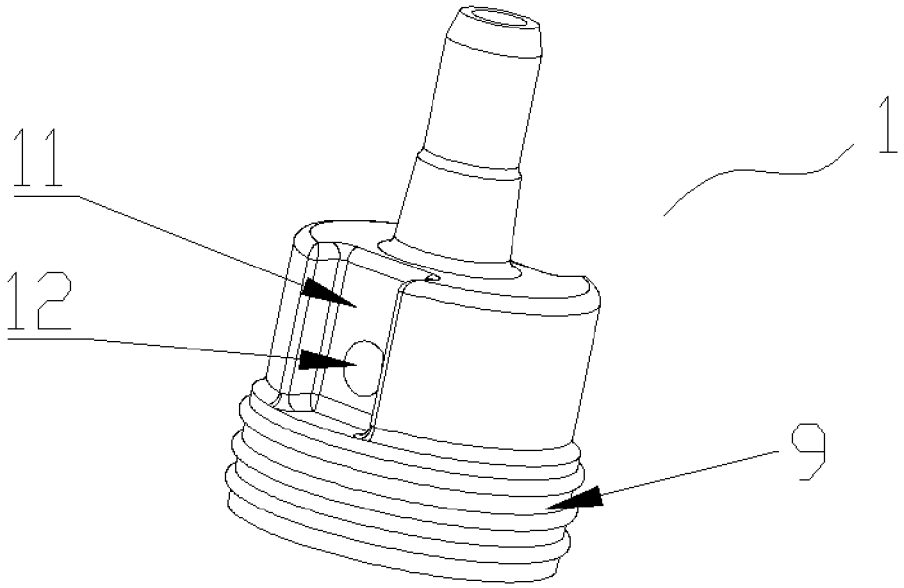
FIG. 4 is a schematic 3D structural diagram of a holding base according to the present invention.
Figure 5:
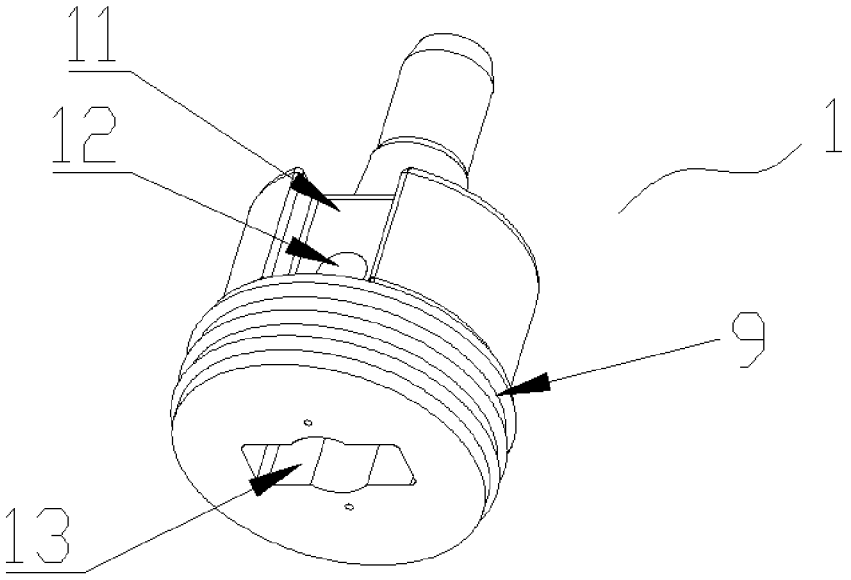
FIG. 5 is a schematic 3D structural diagram of a holding base according to the present invention.

As shown in FIG. 3 to FIG. 5, the holding base 1 described in this embodiment of the present invention is provided with a liquid conveying groove 11 and an accommodating part 12. The heating component 3 is disposed inside the accommodating part 12 and comes in contact with the conductor 5 to form electrical connection. The liquid conveying groove 11 is configured to convey the e-liquid, so that the heating component 3 in the accommodating part 12 is fully in contact with the e-liquid, so as to prevent the heating component 3 from burning or scorching. The accommodating part 12 is preferably a through-hole penetrating the holding base 1. Both ends of the through-hole communicate with the liquid conveying groove 11. With the structure of this embodiment, defects caused by use of the glass fiber wick in the prior art can be avoided, the heating component 3 is very simple to install and does not fall off even during vibration, and the e-liquid does not leak.

As shown in FIG. 3 and FIG. 5, the holding base 1 is further provided with a first ventilation hole or groove 4 and a second ventilation hole or groove 13. The second ventilation hole or groove 13 communicates with the first ventilation hole or groove 4, and a step 10 for stopping e-liquid is disposed at a joint between the first ventilation hole or groove 4 and the second ventilation hole or groove 13, so as to block small liquid droplets of the aerosol that are generated when the heating component 3 atomizes the e-liquid, and prevent the small liquid droplets from entering the user's mouth and affecting the taste of the aerosol. An e-liquid stopping ring 9 is disposed between the holding base 1 and the liquid storage apparatus 2. This can increase friction between the holding base 1 and the liquid storage apparatus 2, to effectively seal the e-liquid.

As shown in FIG. 1 and FIG. 3, the holding base 1 is further provided with an insertion part 16. The insertion part 16 is inserted into the air passage 22 of the liquid storage apparatus 2 and closely fits onto a side wall of the air passage 22, so as to prevent the e-liquid from seeping out of the air passage 22 and causing e-liquid leakage.

Figure 6:
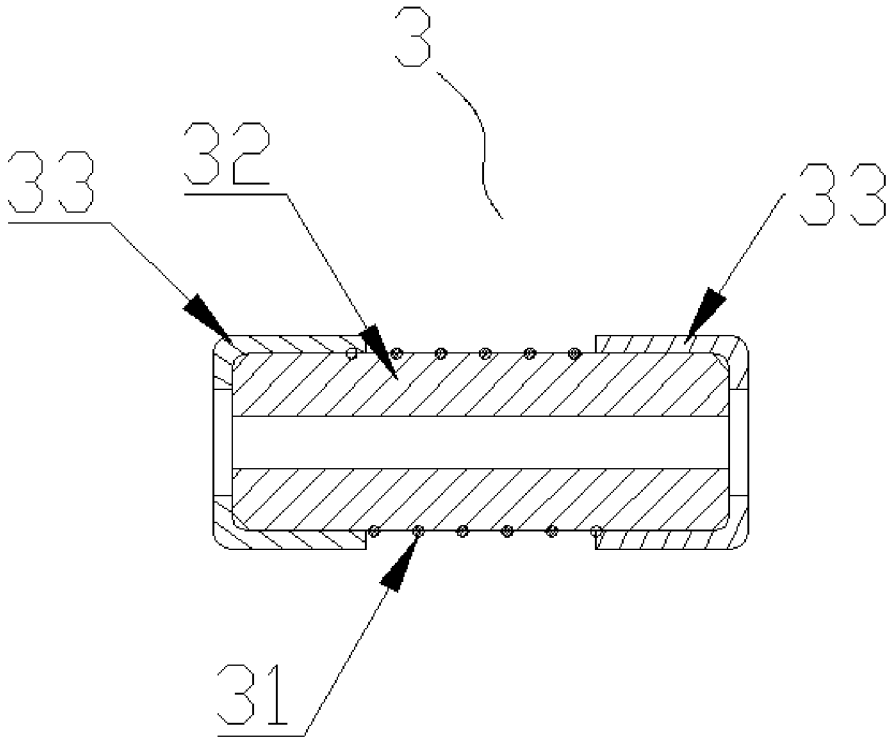
FIG. 6 is a schematic sectional diagram of a heating component according to the present invention.
Figure 7:
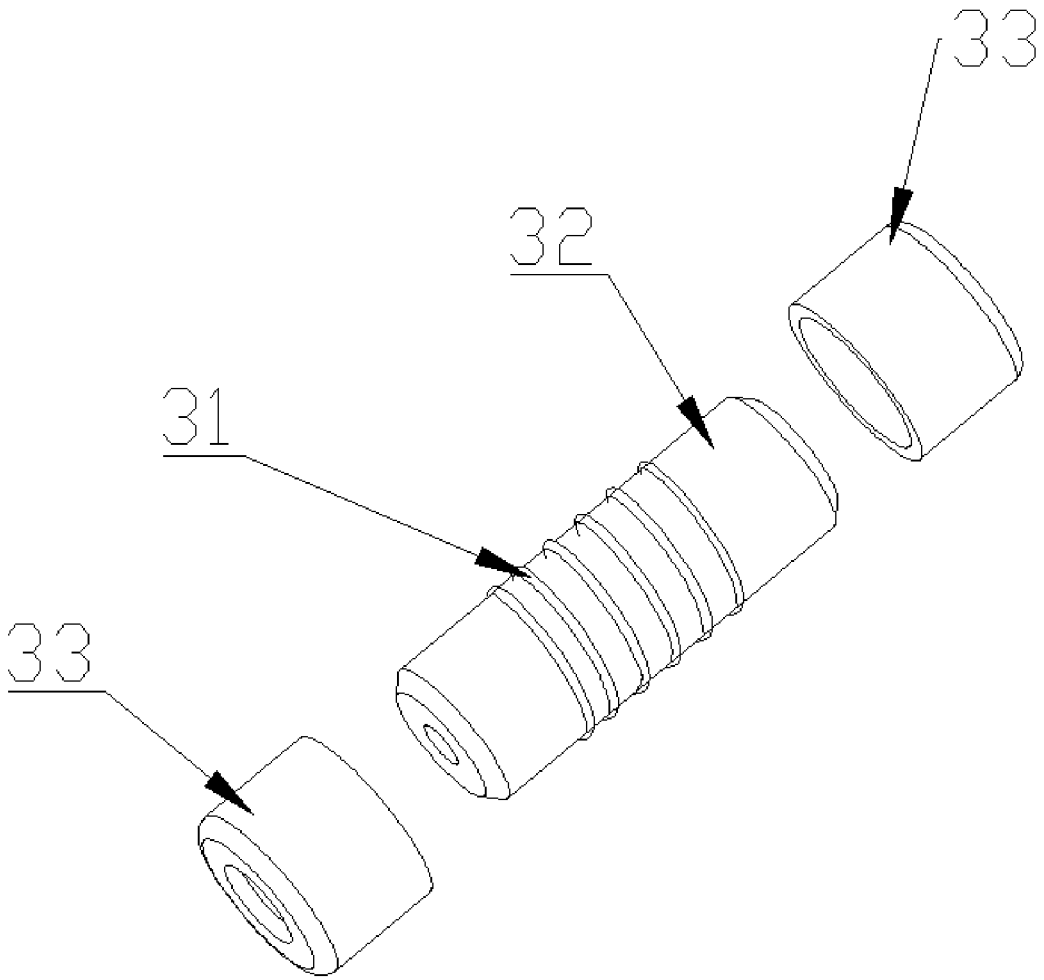
FIG. 7 is a schematic exploded diagram of a heating component according to the present invention.

As shown in FIG. 6 and FIG. 7, the heating component 3 of this embodiment includes a liquid conveying member 32 for adsorbing and conveying liquid. The liquid conveying member 32 is a ceramic member, and a heating filament 31 winds around the liquid conveying member 32. Both ends of the heating component 3 are provided with a conductive part 33, and the conductive part is a conductive material such as brass, iron, and steel. An e-liquid inlet hole is disposed at an end of the conductive part 33. When the conductive part 33 is mounted on the liquid conveying member 32, the e-liquid may enter the liquid conveying member through the liquid inlet hole of the conductive part 33, so as to be atomized by the heating filament; the conductive part 33 and the heating filament 31 are electrically connected to form a closed loop. This is easy to operate and facilitates automatic production.

Figure 8:
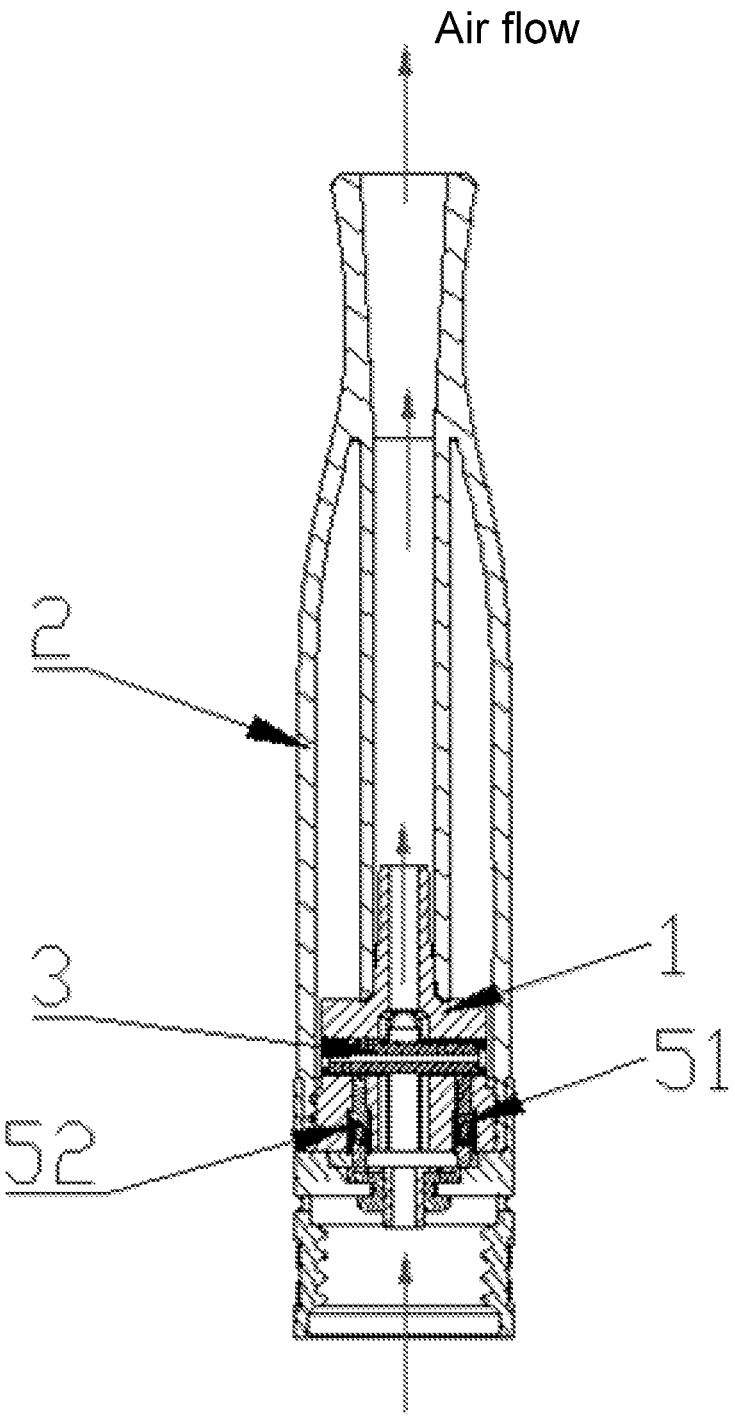
FIG. 8 is a schematic sectional diagram of an atomizer having an elastic conductor according to the present invention.
Figure 9:
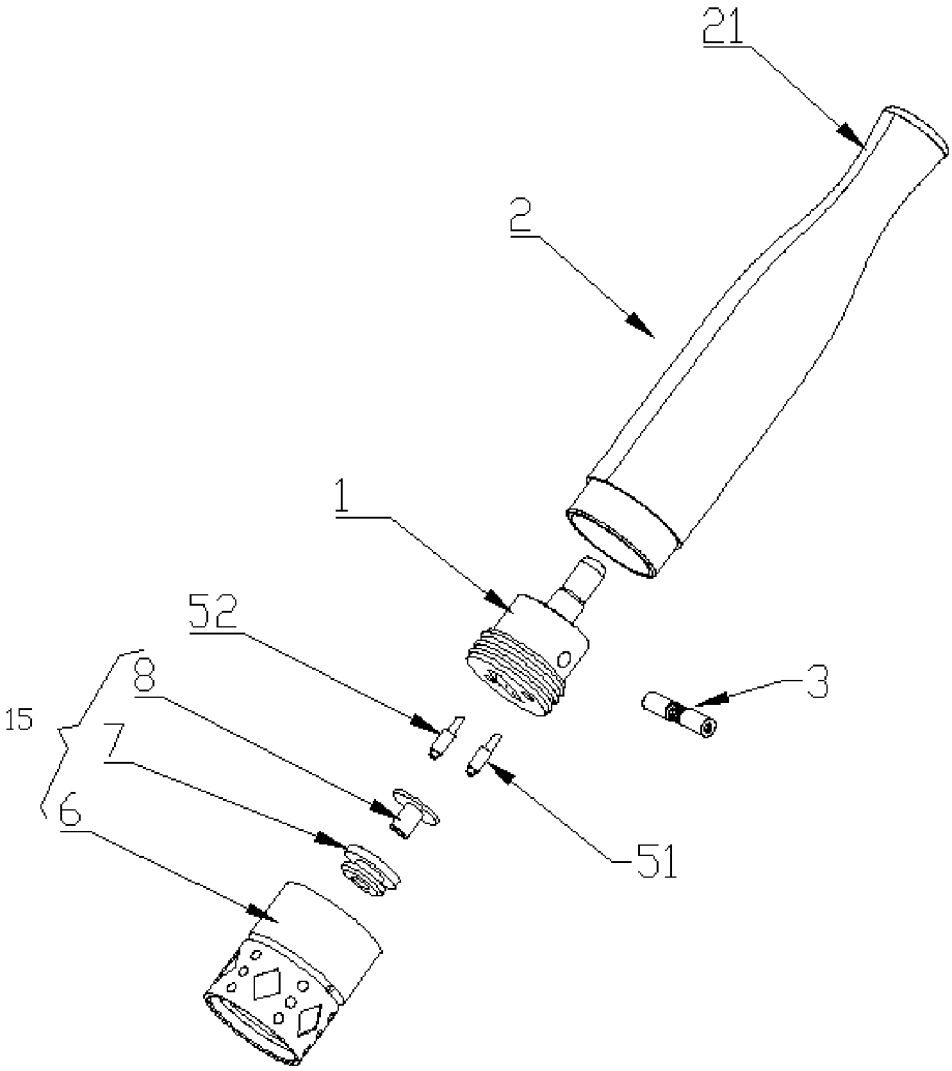
FIG. 9 is a schematic exploded diagram of an atomizer having an elastic conductor according to the present invention.

As shown in FIG. 8 and FIG. 9, the conductor 5 described in this embodiment of the present invention is an elastic conductor. The elastic conductor is disposed inside the holding base 1, so as to obtain better electrical connection. Therefore, use by the user may not be affected by poor electrical contact. In addition, this facilitates automatic production.

Figure 10:
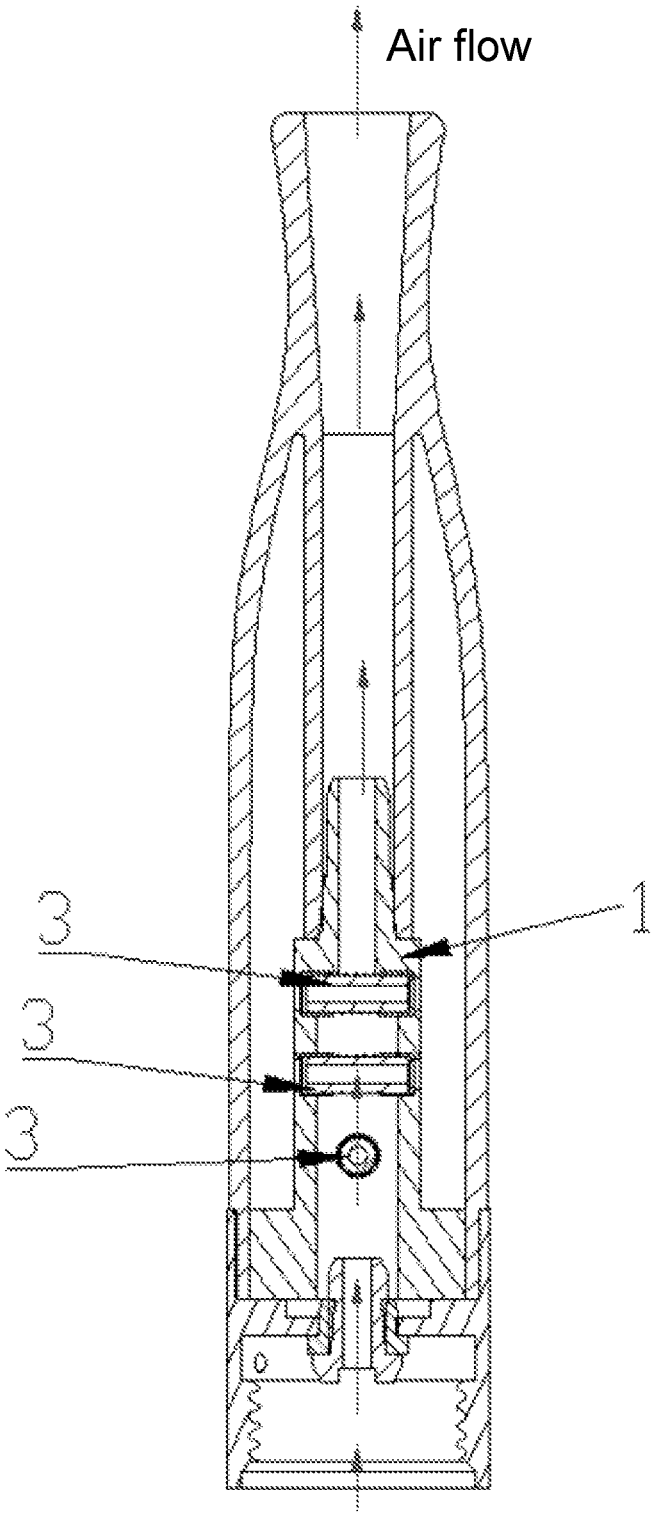
FIG. 10 is a schematic sectional diagram of a holding base having a plurality of heating components according to the present invention.
Figure 11:
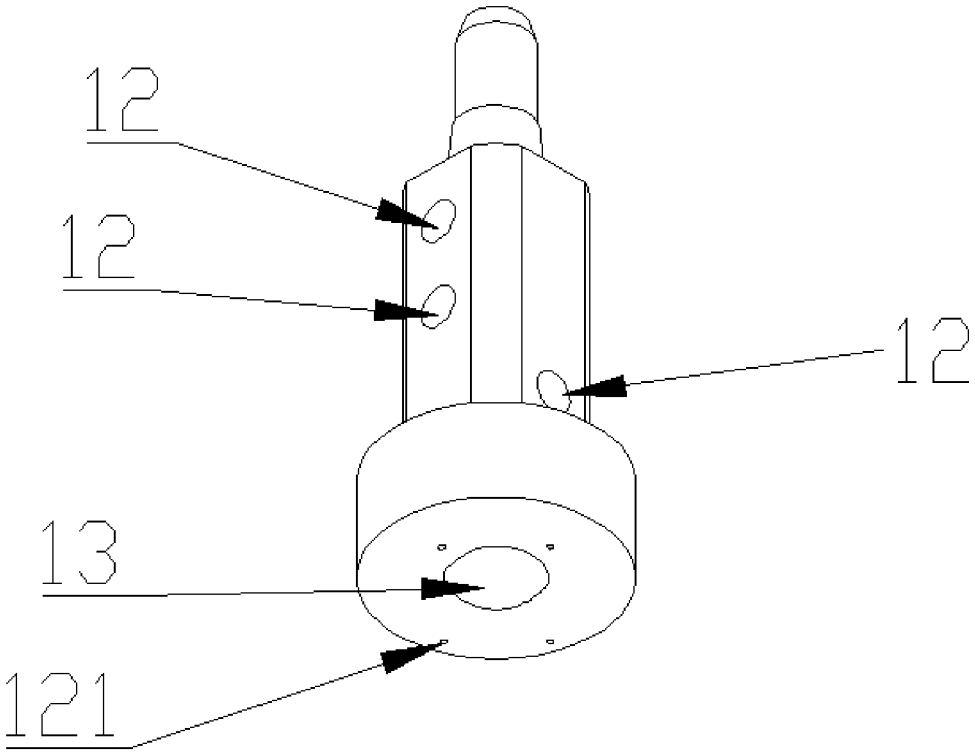
FIG. 11 is a schematic 3D structural diagram of a holding base having a plurality of heating components according to the present invention.

As shown in FIG. 10, the heating component 3 in this embodiment of the present invention includes a plurality of heating components 3, that is, two or more heating components 3 may be disposed in one holding base 1, and the holding base 1 is also correspondingly provided with a same quantity of accommodating parts 12. In this embodiment, there are preferably three heating components 3. The plurality of heating components is capable of providing a greater amount of aerosol. This meets user requirements for large-amount aerosol, and the atomization effect is better with a purer taste. As shown in FIG. 11, correspondingly, the holding base 1 is provided with three accommodating parts 12. A threading hole 121 for threading the heating filament 31 through the liquid conveying member 32 is disposed at the bottom of the holding base 1.

Figure 12:
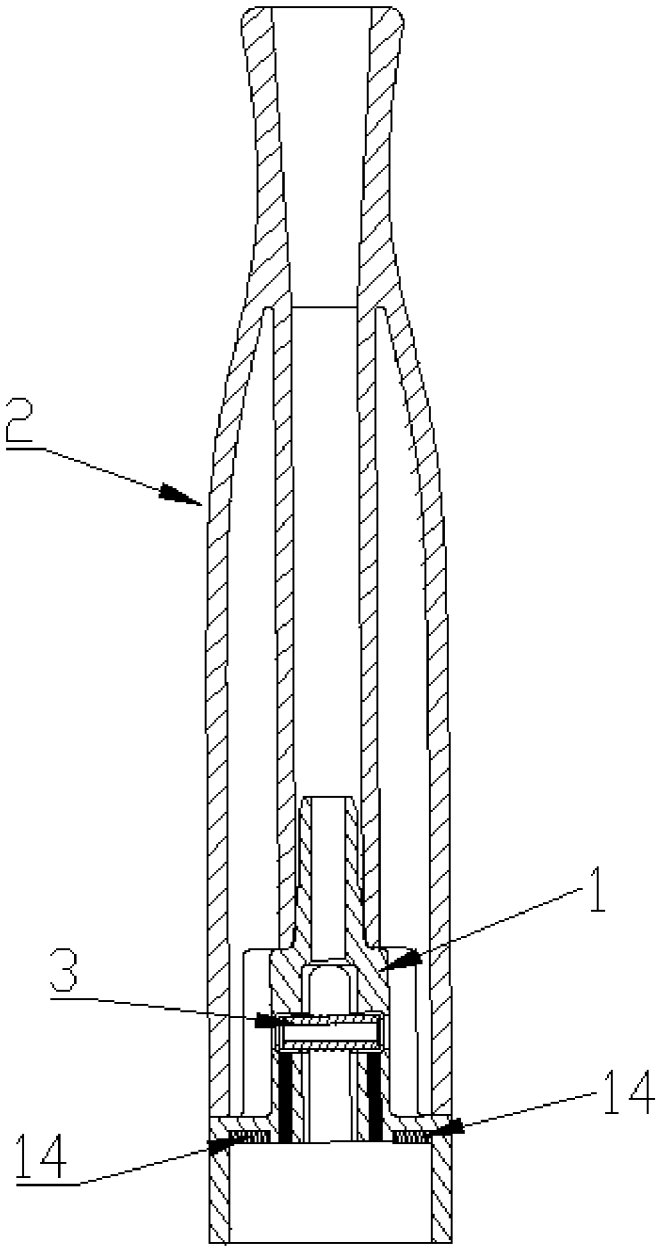
FIG. 12 is a schematic sectional diagram of a holding base provided with a magnet according to the present invention.

As shown in FIG. 12, in this embodiment of the present invention, the holding base 1 and the connector 6 are integrally molded. The holding base 1 and the liquid storage apparatus 2 are closely fitted and connected, so that the holding base 1 and the liquid storage apparatus 2 are detachably connected. This facilitates e-liquid filling and cleaning of the liquid storage apparatus 2 for the user. In addition, the holding base 1 is provided with a magnet 14 or a clasp or a thread, and is connected to the battery rod 17 of the e-cigarette by using the magnet 14 or the clasp or the thread, so as to implement electrical connection between the atomizer and the battery rod 17.

The holding base 1 described in this embodiment may be an insulator such as silicone or plastic, or may be metal that has been specially processed to form an insulator.

The embodiments of the present invention have been described with reference to the drawings. The foregoing specific implementations are merely illustrative but are not intended to limit the scope of the present invention. As instructed by the present invention, persons of ordinary skill in the art may further derive many other implementations without departing from principles of the present invention and the protection scope of the claims, and all such implementations fall within the scope of the present invention.

What is claimed is:

1. An atomizer, configured to combine with a battery rod to form an e-cigarette, characterized in that the atomizer comprises an electrode component and a heating component, wherein a liquid storage apparatus for storing liquid is disposed at one end of the electrode component and the battery rod is electrically connected to the other end of the electrode component, an air passage for discharging the aerosol and a holding base for holding the heating component are disposed inside the liquid storage apparatus, an accommodating part is disposed in the holding base, and the heating component is fixedly accommodated inside the accommodating part;

wherein the holding base is further provided with a conductor electrically connected to the heating component, and the conductor is inserted into the holding base or is integrally molded with the holding base;

Wherein the conductor is abutted or clamped or welded to the electrode component to form electrical connection.

2. The atomizer according to claim 1, wherein the accommodating part is a through-hole penetrating the holding base.

3. The atomizer according to claim 2, wherein the holding base is further provided with a first ventilation groove or hole and a second ventilation groove or hole, the first ventilation groove or hole and the second ventilation groove or hole communicate with each other, and a step for stopping e-liquid droplets of the aerosol is disposed at a joint between the first ventilation groove or hole and the second ventilation groove or hole.

4. The atomizer according to claim 3, wherein an e-liquid stopping ring closely fitting the liquid storage apparatus and a liquid conveying groove for conveying the e-liquid are disposed in the holding base, and the liquid conveying groove communicates with the through-hole.

5. The atomizer according to claim 1, wherein the conductor comprises a first conductor and a second conductor, the electrode component comprises a connector, an inner electrode, and an insulating ring mounted between the connector and the inner electrode, the first conductor is electrically connected to the connector and the second conductor is electrically connected to the inner electrode, or the first conductor is electrically connected to the inner electrode and the second conductor is electrically connected to the connector.

6. The atomizer according to claim 1, wherein the heating component comprises a liquid conveying member for adsorbing and conveying liquid, a heating filament disposed on the liquid conveying member, and an electrically conductive part that is embedded at both ends of the liquid conveying member and electrically connected to the heating filament.

7. The atomizer according to claim 6, wherein there are one or more heating components.

8. The atomizer according to claim 5, wherein the holding base is integrally molded with the connector, the holding base is provided with any one or a combination of a magnet, a clasp, or a thread, and the atomizer is connected to the battery rod by using the magnet, the clasp, or the thread.

9. An e-cigarette, comprising a battery rod, wherein the battery rod is integrally molded with or detachably connected to the atomizer according to claim 8.

* * * * *